US007324058B2

(12) United States Patent
Kai et al.

(10) Patent No.: US 7,324,058 B2
(45) Date of Patent: Jan. 29, 2008

(54) TAG ANTENNA, TAG AND RFID SYSTEM USING THE SAME

(75) Inventors: Manabu Kai, Kawasaki (JP); Toru Maniwa, Kawasaki (JP); Takashi Yamagajo, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 47 days.

(21) Appl. No.: 11/349,179

(22) Filed: Feb. 8, 2006

(65) Prior Publication Data

US 2007/0085751 A1 Apr. 19, 2007

(30) Foreign Application Priority Data

Oct. 19, 2005 (JP) ..... 2005-303886

(51) Int. Cl.
*H01Q 9/28* (2006.01)

(52) U.S. Cl. ..... 343/795; 343/793

(58) Field of Classification Search ..... 343/700 MS, 343/793, 795, 895; 340/572.7
See application file for complete search history.

(56) References Cited

U.S. PATENT DOCUMENTS

| | | | | |
|---|---|---|---|---|
| 4,860,019 | A | 8/1989 | Jiang et al. | |
| 5,986,609 | A * | 11/1999 | Spall | 343/702 |
| 6,147,606 | A | 11/2000 | Duan | |
| 6,285,342 | B1 * | 9/2001 | Brady et al. | 343/895 |
| 6,313,809 | B1 | 11/2001 | Gabriel et al. | |
| 6,417,816 | B2 * | 7/2002 | Sadler et al. | 343/795 |
| 6,535,175 | B2 * | 3/2003 | Brady et al. | 343/795 |
| 6,844,851 | B2 | 1/2005 | Yoon et al. | |
| 2002/0005811 | A1 * | 1/2002 | Tsai et al. | 343/795 |
| 2005/0024287 | A1 | 2/2005 | Jo et al. | |

FOREIGN PATENT DOCUMENTS

| | | |
|---|---|---|
| DE | 19703864 | 6/1998 |
| EP | 1 271 692 | 1/2003 |
| EP | 1 542 312 | 6/2005 |
| JP | 2004-334432 | 11/2004 |
| JP | 2005-216077 | 8/2005 |
| WO | WO 00/39894 | 7/2000 |

OTHER PUBLICATIONS

Constantine A. Balanis, *Antenna Theory: Analysis and Design*, New York, NY: John Wiley & Sons, pp. 17-21, no dated.

* cited by examiner

*Primary Examiner*—Tho Phan
(74) *Attorney, Agent, or Firm*—Bingham McCutchen LLP

(57) ABSTRACT

A communication distance difference due to an attached object can be canceled, and an RFID system can be provided which has approximately the same communication distance regardless of an attached position (surface) of a tag. A tag antenna used for such the RFID system is for transmitting/receiving a radio signal to/from an RFID reader/writer in an RFID system has a pair of antenna elements centered on a feeding point and when a carrier wavelength of the radio signal is λ, each of the pair of the antenna elements includes a dipole portion which has a length from the feeding point of approximate λ/4 and a plurality of bending portions as well as a circular polarized wave generation portion linked to an end of the dipole portion.

9 Claims, 21 Drawing Sheets

TAG ANTENNA, TAG AND RFID SYSTEM USING THE SAME

CROSS-REFERENCE TO RELATED APPLICATIONS

This application is based upon and claims the benefit of priority from the prior Japanese Patent Application No. 2005-303886, filed on Oct. 19, 2005, the entire contents of which are incorporated herein by reference.

BACKGROUND OF THE INVENTION

1. Field of the Invention

The present invention relates to a non-contact tag antenna for transmission and reception to/from an RFID reader/writer and an RFID system using the same.

2. Description of the Related Art

An RFID (Radio Frequency Identification) system is a system which can read information in a tag with a reader/writer by transmitting a signal of about 1 W from the reader/writer with the use of a radio signal in UHF band (860 to 960 MHz); receiving the signal with a tag antenna on the tag side; processing the received signal with a chip; and sending back a response signal to the reader/writer side.

Various propositions have been made as such a system. Among the propositions, a configuration using a tag antenna is known (e.g., Japanese Patent Application Laid-Open Publication Nos. 2004-334432 and 2005-216077).

Although dependent on the gain of the tag antenna, an operation voltage of a chip and a surrounding environment, the communication distance thereof is on the order of 3 m.

FIG. 1 is a diagram showing a configuration example of a tag, with the tag having a dipole antenna 1 as an example of an antenna and a chip 2 connected a feeding point. In other words, the tag includes the antenna 1 with a thickness on the order of 0.1 mm and the LSI chip 2 (about 1 mm square, on the order of 0.2 mm thick) connected to the antenna feeding point.

FIG. 2 shows an equivalent circuit of the tag. The antenna 1 can be equivalently shown by parallel connection of a resistance Ra (e.g., 500 Ω) and an inductance La (e.g., 40 nH) while the LSI chip 2 can be equivalently shown by parallel connection of a resistance Rc (e.g., 1200 Ω) and a capacitance Cc (e.g., 0.7 pF).

When represented on an admittance chart shown in FIG. 3, the antenna 1 and the LSI chip 2 are located in positions represented by A and B shown in FIG. 3, respectively. Therefore, by connecting the antenna 1 and the LSI chip 2 in parallel, the capacitance and the inductance are resonated and matched at a desired resonance frequency F0 as understood from equation 1, and the received power of the antenna 1 is sufficiently supplied to the chip 2 side.

$$f0 = \frac{1}{2\pi\sqrt{LC}} \tag{1}$$

As a basic antenna used as the tag antenna, although a dipole antenna with a length of about 145 mm as shown in FIG. 1 is conceivable, as shown in FIG. 3, an impedance is f=953 MHz, a real part impedance Ra=72 Ω and an imaginary part=0. However, since the RFID tag antenna requires very high Ra which is on the order of 500 to 2000 Ω, Ra must be increased.

Therefore, as shown in FIG. 4, an antenna (folded dipole antenna) is used which has a folded dipole portion 3 with a length of about 145 mm, and it is well known that Ra can be increased to about 300 Ω to 500 Ω, although varied by a line width.

In the admittance chart of FIG. 3, an example of Ra=500 Ω is shown by C in the figure. As shown in FIG. 5, by connecting inductance 4 in parallel with the folded dipole antenna, anticlockwise rotation is made on the admittance chart of FIG. 3 to give an imaginary number component ($Ba=-1/\omega La$) of an absolute value which is the same as the chip ($Bc=\omega Cc$).

The longer the inductance length is, the smaller the La value is and the greater the rotation amount is. Therefore, the imaginary number component Bc of the chip and the imaginary number component Ba of the antenna have the same magnitude and are cancelled and resonated. This cancellation of the imaginary number components is the most important factor for the RFIC tag antenna design. On the other hand, although the resistance Rc of the chip and the antenna radiation resistance Ra are desired to be matched, the resistances are not needed to be matched precisely.

The tag is typically linearly polarized and the antenna on the reader/writer side is circularly polarized (rightward polarization or leftward polarization, an axial ratio=about 0.5 to 3 dBi) in order to be able to receive regardless of the direction to which the tag faces.

As described above, in a typical RFID system, since an antenna on the reader/writer side is circularly polarized and the tag side is linearly polarized, a communication distance is the same regardless of the sides of the tag. If the tag is configured with complete circular polarization, although a communication distance is increased in a direction identical to a rotation direction of circular polarization on the reader/writer side, when the tag is reversed, a communication distance is reduced drastically since a rotation direction is reversed.

In the RFID system, the tag is attached to some sort of object to perform reading or writing, and the target object for attaching the tag has a certain degree of size, of course. When using a conventional linearly polarized tag as the tag, if reading is attempted from the back side which is opposite to the attaching side of the tag, a communication distance is decreased by the size of the attached object.

For example, when a conventional linearly polarized tag has a communication distance of 3 m, if a target object for attaching the tag has a thickness of about 1.4 m, although the communication distance from the tag-attached side is still 3 m, the communication distance from the back side of the target object for attaching the tag is 3 m−1.4 m=1.6 m, which is practically problematic.

If the tag has appropriate linearly polarized and appropriate circularly polarized components, for example, when the tag is faced to the reader/writer, the communication distances can be differentiated between the sides of the tag such that the communication distance is 3.9 m on the front side (direction identical to the direction of circular polarization) and 2.1 m on the back side (direction not identical to the direction of circular polarization). In the above example, if the front side with the increased distance is attached to the attached object, since the communication distance from the side with the tag attached is 2.1 m and the communication distance from the opposite side of the attached object is 3.9 m 1.4 m=2.5 m, the communication distances from the attached object can be made about the same distances in the practical use.

However, an antenna with such a characteristic does not exist. In consideration of the practical operation, the antenna must be to the extent of a card size. In the LSI chip 2, the resistance Rc (e.g., 1200 Ω) and the capacitance Cc (e.g., 0.7 pF) must be matched.

SUMMARY OF THE INVENTION

It is therefore the object of the present invention to provide a tag antenna and an RFID system using the same, satisfying a solution requirement for a problem that a communication distance is reduced by a size of an attached object if a tag is read from the back side opposite to the tag-attached side in the case of using such a linearly polarized tag.

In order to achieve the above object of the present invention, according to a first aspect of the present invention there is provided a tag antenna for transmitting/receiving a radio signal to/from an RFID reader/writer in an RFID system, comprising a pair of antenna elements centered on a feeding point, wherein when a carrier wavelength of the radio signal is λ, each of the pair of the antenna elements comprises a dipole portion which has a length from the feeding point of approximate λ/4 and a plurality of bending portions; and a circular polarized wave generation portion linked to an end of the dipole portion. Each dipole portion of the pair of the antenna elements may include two (2) parallel linear portions and a third linear potion linking the two (2) linear portions, with an end of one linear portion of the two (2) parallel linear portions being connected to a feeding point, with the circular polarized wave generation portion being connected to an end of the other linear portion of the two (2) parallel linear portions; and the circular polarized wave generation portion having a triangular shape having a first side conforming with an extending direction of the other linear portion of the two (2) parallel linear portions and a second side perpendicular to the first side.

The second side of the circular polarized wave generation portion may face toward the feeding point so as to be parallel to the third linear portion of the dipole portion.

The two (2) parallel linear portions of the dipole portion may have a length of λ/4 and wherein the third linear portion has a length of λ/2.

The first side and the second side of the circular polarized wave generation portion may respectively have a length of λ/15 to λ/8.

Each dipole portion of the pair of the antenna elements may include two (2) parallel linear portions and a third linear potion linking the two (2) linear portions, with an end of one linear portion of the two (2) parallel linear portions being connected to a feeding point, with the circular polarized wave generation portion being connected to an end of the other linear portion of the two (2) parallel linear portions, and with the circular polarized wave generation portion being formed in an L-shape with a first linear portion conforming with an extending direction of the other linear portion of the two (2) parallel linear portions and a second linear portion perpendicular to the first linear portion.

The second linear portion of the circular polarized wave generation portion may face toward the feeding point to so as to be parallel to the third linear portion of the dipole portion. Each dipole portion of the pair of the antenna elements may include two (2) parallel linear portions and a third linear potion linking the two (2) linear portions, with an end of one linear portion of the two (2) parallel linear portions being connected to a feeding point, with the circular polarized wave generation portion being connected to an end of the other linear portion of the two (2) parallel linear portions, and with the circular polarized wave generation portion being formed in an F-shape with a first linear portion conforming with an extending direction of the other linear portion of the two (2) parallel linear portions and a second linear portion and a third linear portion perpendicular to the first linear portion.

The second linear portion and the third linear portion of the circular polarized wave generation portion may face toward the feeding point to be parallel to the third linear portion of the dipole portion.

Each dipole portion of the pair of the antenna elements may include two (2) parallel linear portions and a third linear potion linking the two (2) linear portions, with an end of one linear portion of the two (2) parallel linear portions being connected to a feeding point, the circular polarized wave generation portion being connected to an end of the other linear portion of the two (2) parallel linear portions, and with the circular polarized wave generation portion having a rectangular shape having a side conforming with an extending direction of the other linear portion of the two (2) parallel linear portions.

The pair of the antenna elements may be a thin sheet made of any one of Cu, Ag and Al and is disposed on a nonconductive sheet.

In order to achieve the above object, according to a second aspect of the present invention there is provided a tag comprising a tag antenna of any one of claims 1 to 11; and an LSI chip disposed on a feeding portion of the tag antenna, the LSI chip having a communication function for performing reception processing of a radio signal from an RFID reader/writer and for responding to the RFID reader/writer.

In order to achieve the above object, according to a third aspect of the present invention there is provided an RFID system comprising a tag of claim 12; and an RFID reader/writer for sending a carrier signal to the tag, the RFID receiver/writer receiving a response to the carrier signal from the tag to recognize information of the tag.

BRIEF DESCRIPTION OF THE DRAWINGS

The above and other objects, aspects, features and advantages of the present invention will become more apparent from the following detailed description when taken in conjunction with the accompanying drawings, in which.

DESCRIPTION OF THE PREFERRED EMBODIMENTS

Exemplary embodiments of the present invention will now be described with reference to the accompanying drawings.

First Embodiment

Figure 1:
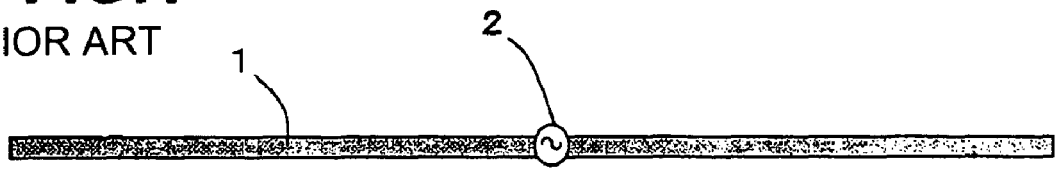
FIG.1 PRIOR ART
FIG. 1 is a diagram showing a configuration example of a tag.
Figure 2:
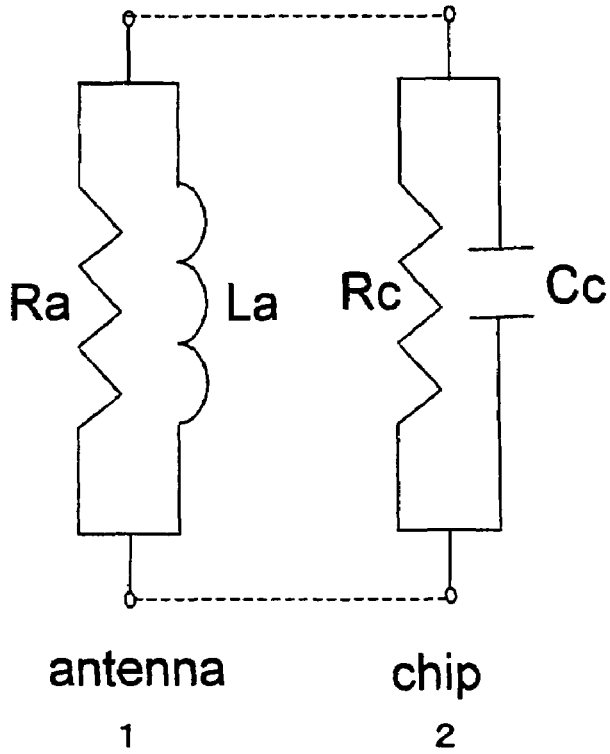
FIG.2 PRIOR ART
FIG. 2 is a diagram showing an equivalent circuit of the tag.
Figure 3:
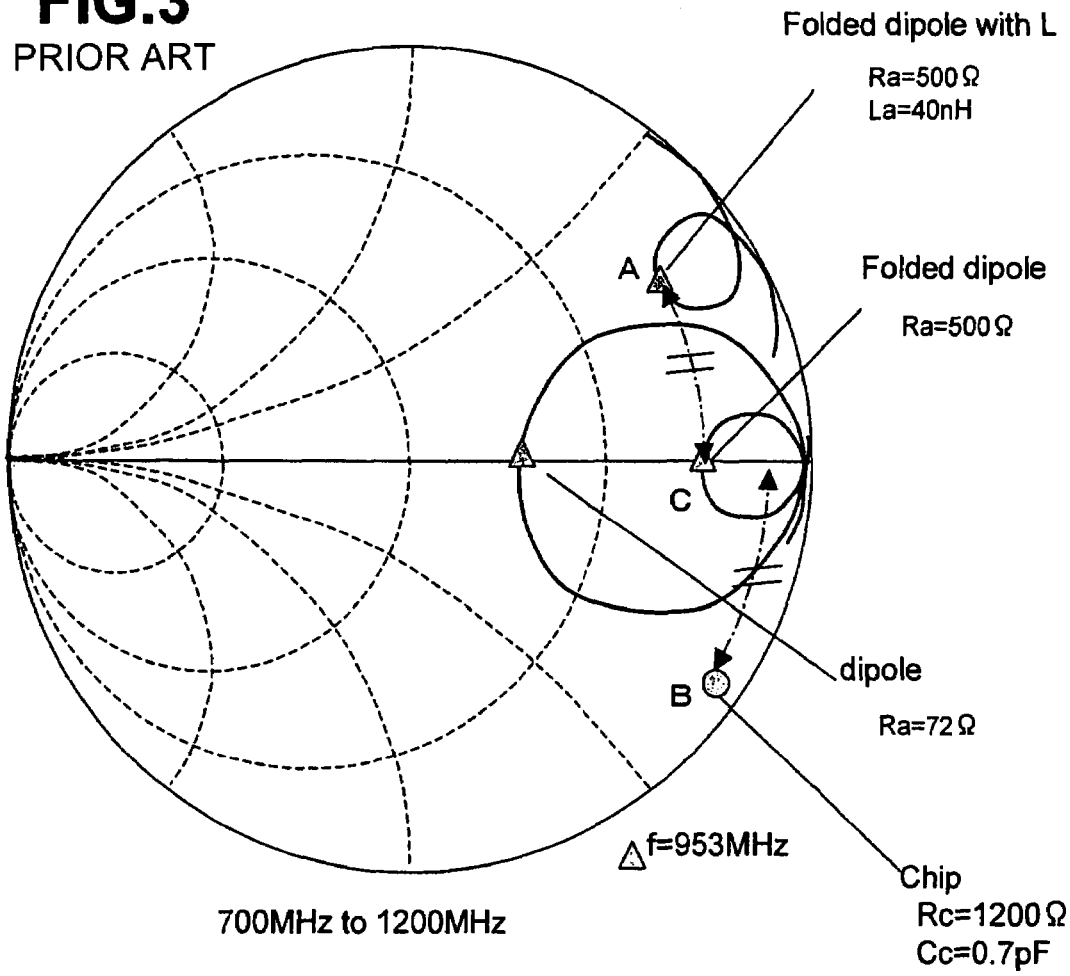
FIG.3 PRIOR ART
FIG. 3 is a diagram showing an admittance chart.
Figure 4:
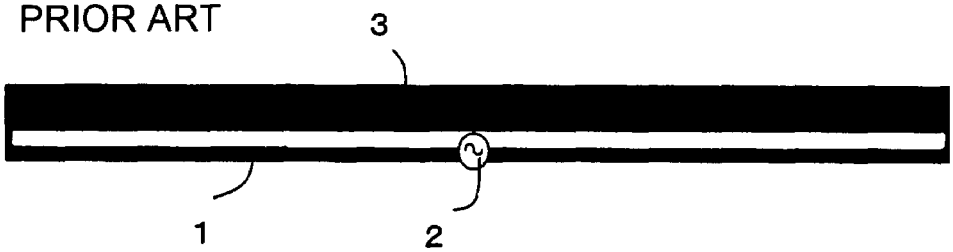
FIG.4 PRIOR ART
FIG. 4 is a diagram describing an antenna with a folded dipole portion.
Figure 5:
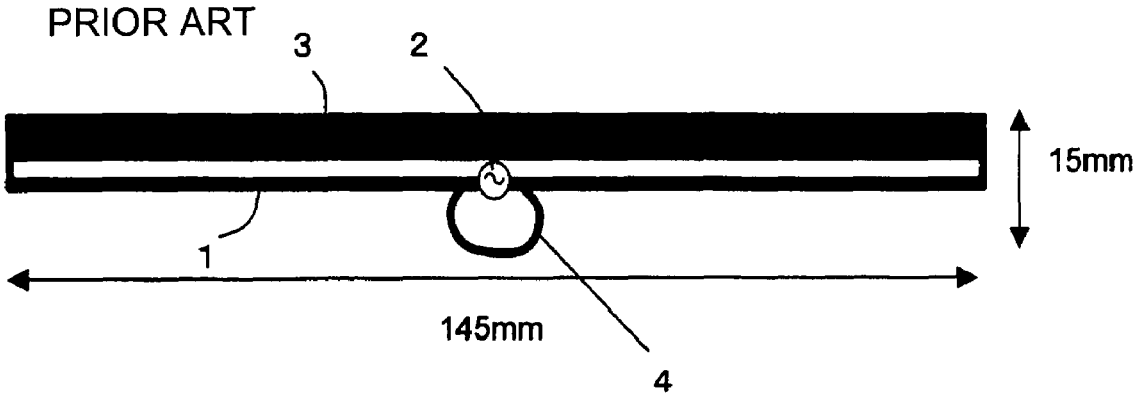
FIG.5 PRIOR ART
FIG. 5 is a diagram describing an antenna connected with inductance in parallel with a folded dipole antenna.
Figure 6:
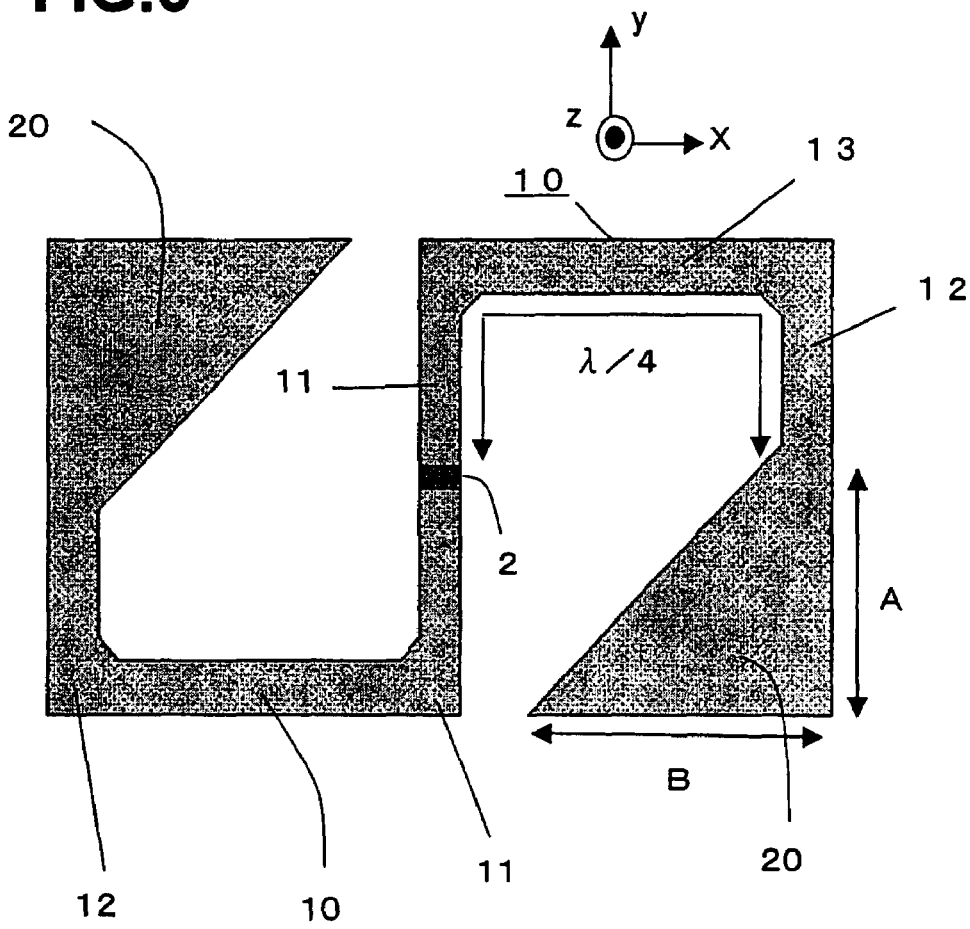
FIG. 6 is a plan view of a first embodiment configuration of a tag antenna according to the present invention.

FIG. 6 is a plan view of a first embodiment configuration of a tag antenna according to the present invention. The tag antenna has a pair of antenna elements, centered on a feeding point 2. When a carrier wavelength of a radio signal is λ, each of the pair of the antenna elements includes a dipole portion 10 which has a length from the feeding point 2 of approximate λ/4 and a plurality of bending portions as well as a circular polarized wave generation portion 20 linked to an end of the dipole portion 10.

The outside dimensions can be on the order of 78 mm*44 mm, as an antenna size to the extent of a card size (86 mm*54 mm). In order to increase an antenna length within the size as much as possible, the dipole portion 10 is formed which has a length of λ/4 with two (2) 90-degree bending portions from the feeding point 2. The antenna element has the circular polarized wave generation portion 20 leading to an end of the dipole portion 10.

In this way, each dipole portion 10 of the pair of the antenna elements can be recognized such that the dipole portion 10 includes two (2) parallel linear portions 11, 12 and a third linear potion 13 linking the two (2) linear portions 11, 12. A length of each of the two (2) parallel linear portions 11, 12 is λ/16 and a length of the third linear potion 13 is λ/8.

An end of one linear portion 11 of the two (2) parallel linear portions 11, 12 is connected to the feeding point 2 and the circular polarized wave generation portion 20 is connected to an end of the other linear portion 12 of the two (2) parallel linear portions 11, 12.

In the embodiment shown in FIG. 6, the circular polarized wave generation portion 20 is formed as a triangular portion with a length A: 24 mm (about λ/12) and a breadth B: 30 mm (about λ/10)

The material of the antenna conductor is a thin sheet of Cu (copper) with a thickness of about 20 μm and the tag antenna is formed by attaching the antenna conductor to a PET (polyethylene terephthalate) sheet with a thickness of about 70 μm.

Figure 7:
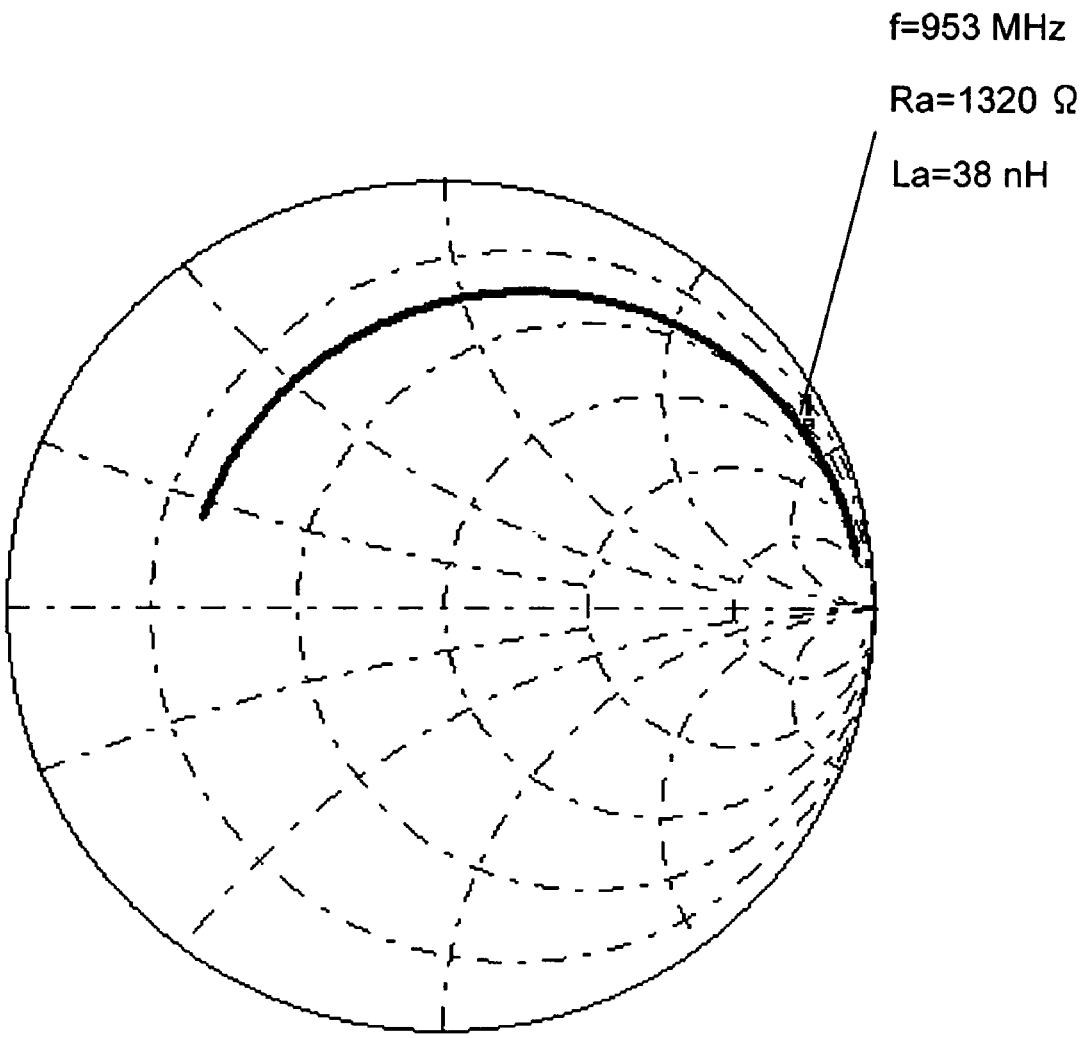
FIG. 7 shows an impedance characteristic of the antenna of the embodiment configuration of FIG. 6.

FIG. 7 shows an impedance characteristic of the antenna of the embodiment configuration of FIG. 6, obtained by a commercially available electromagnetic field simulator. As shown in FIG. 7, impedance is f=953 MHz, Ra=1320 Ω and La=38 nH and can be matched with an LSI chip provided on the feeding point 2.

Figure 8:
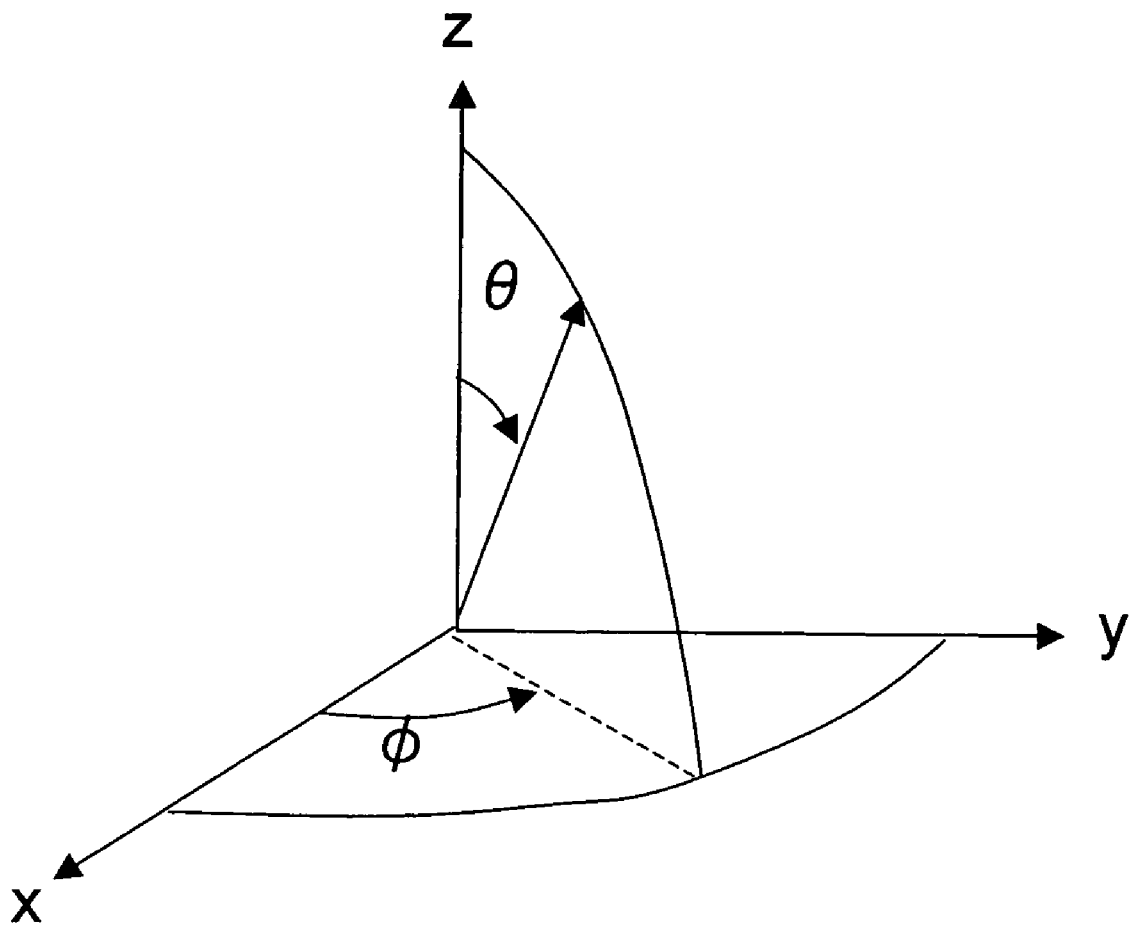
FIG. 8 is a diagram defining angles θ and Φ of three (3) axes X, Y, Z.

Angles θ and Φ of three (3) axes X, Y, Z are defined as shown in FIG. 8.

Figure 9:
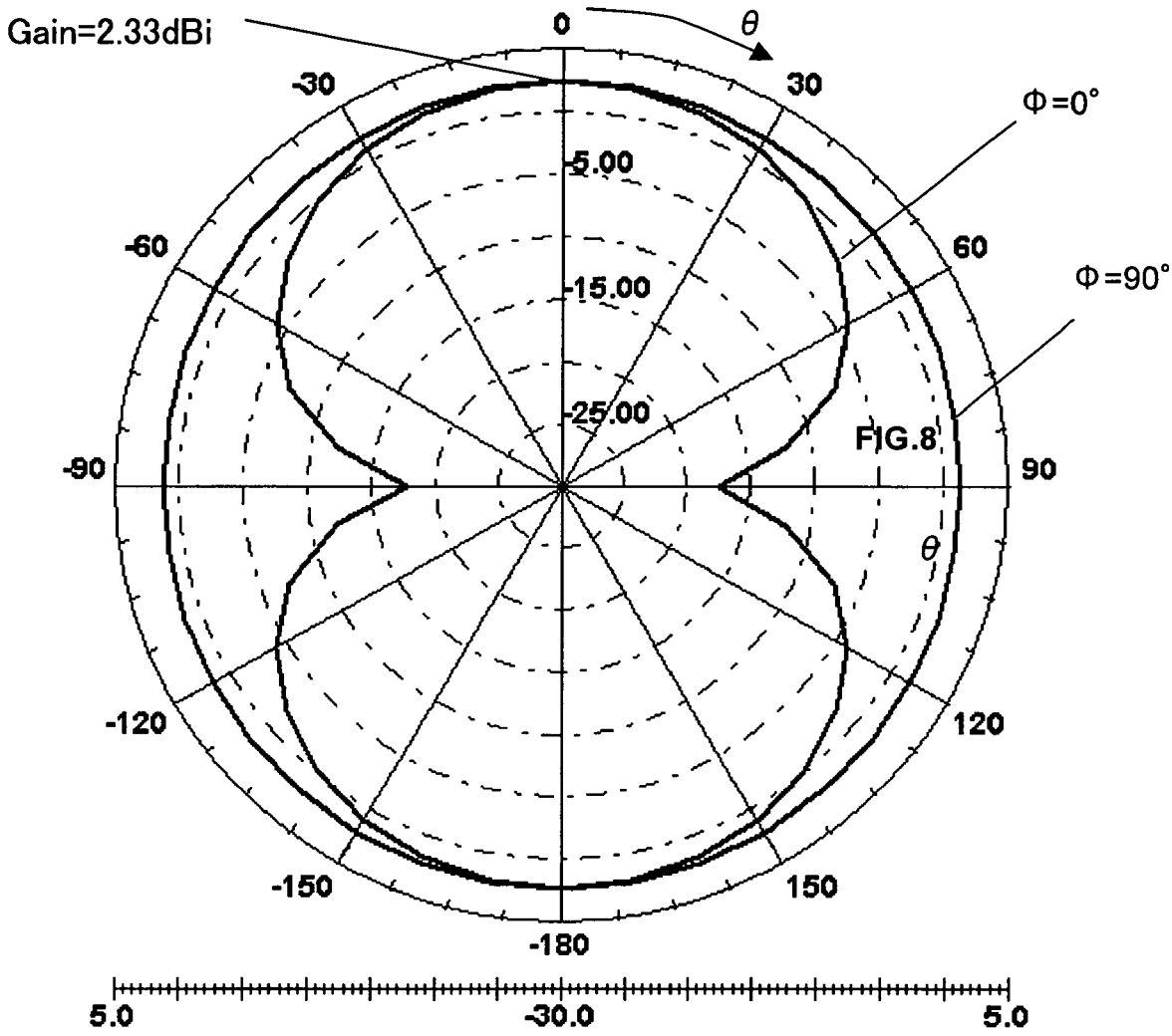
FIG. 9 is a diagram showing an antenna gain and a radiation pattern of the embodiment of FIG. 6.
Figure 10:
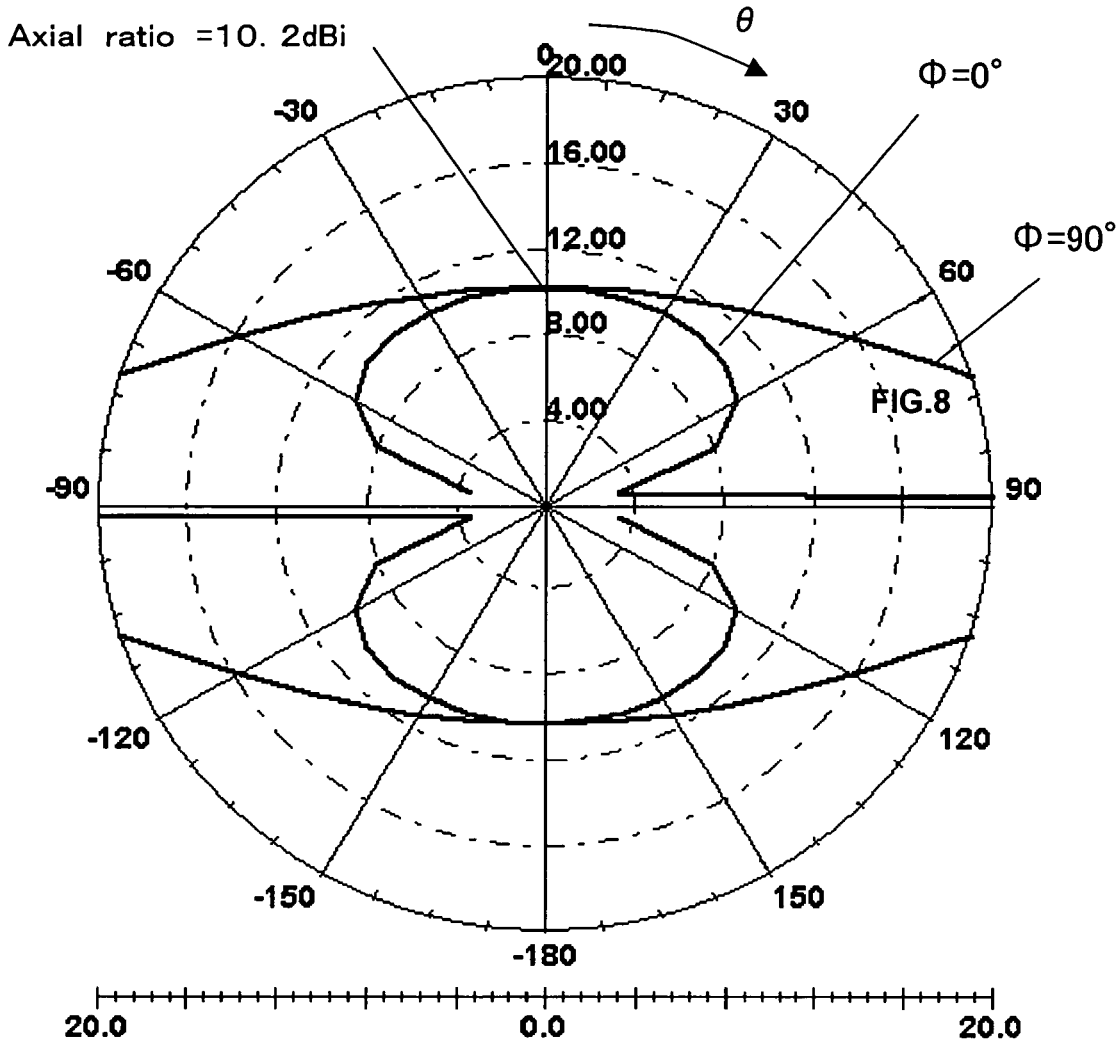
FIG. 10 is a diagram showing an axial ratio of the antenna of the embodiment of FIG. 6.

As shown in FIG. 9, an antenna gain in the antenna front side direction (z direction: θ=0) is 2.33 dBi with a somewhat sharp radiating pattern and the gain is somewhat higher than a typical dipole antenna gain of 2.15 dBi As shown in FIG. 10, an axial ratio (AR) of the antenna is 10.2 dB (leftward polarization). The axial ration of the antenna can be described as follows. With regard to a circularly polarized wave, when the direction of an electric field is rotated in a plane vertical to a movement direction of an electric wave at a frequency equivalent to the exciting frequency thereof, the polarized wave is referred to as a circularly polarized wave.

Because of a difference in the rotation direction, the circularly polarized wave is classified as a leftward circularly polarized wave and a rightward circularly polarized wave. Although the circularly polarized wave can be realized by combining two (2) linearly polarized waves with equal amplitude and a phase difference of 90 degrees from each other, it is practically difficult to realize a completely circularly polarized wave and an elliptically polarized wave is formed. Therefore, an axial ratio (AR) is used for an index representing how close to the circularly polarized wave. When an axial ratio value is closer to 1, a polarized wave is closer to the circularly polarized wave.

Assuming that an axial ratio of the reader/writer side is 1 dBi and that an axial ratio of the tag is 10 dB, if circular polarization directions are identical, it is predicted that the communication distance of the linearly polarization tag is increased by about 30%, and if circular polarization directions are not identical, it is predicted that the communication distance of the linear polarization tag is decreased by about 30%.

Figure 11:
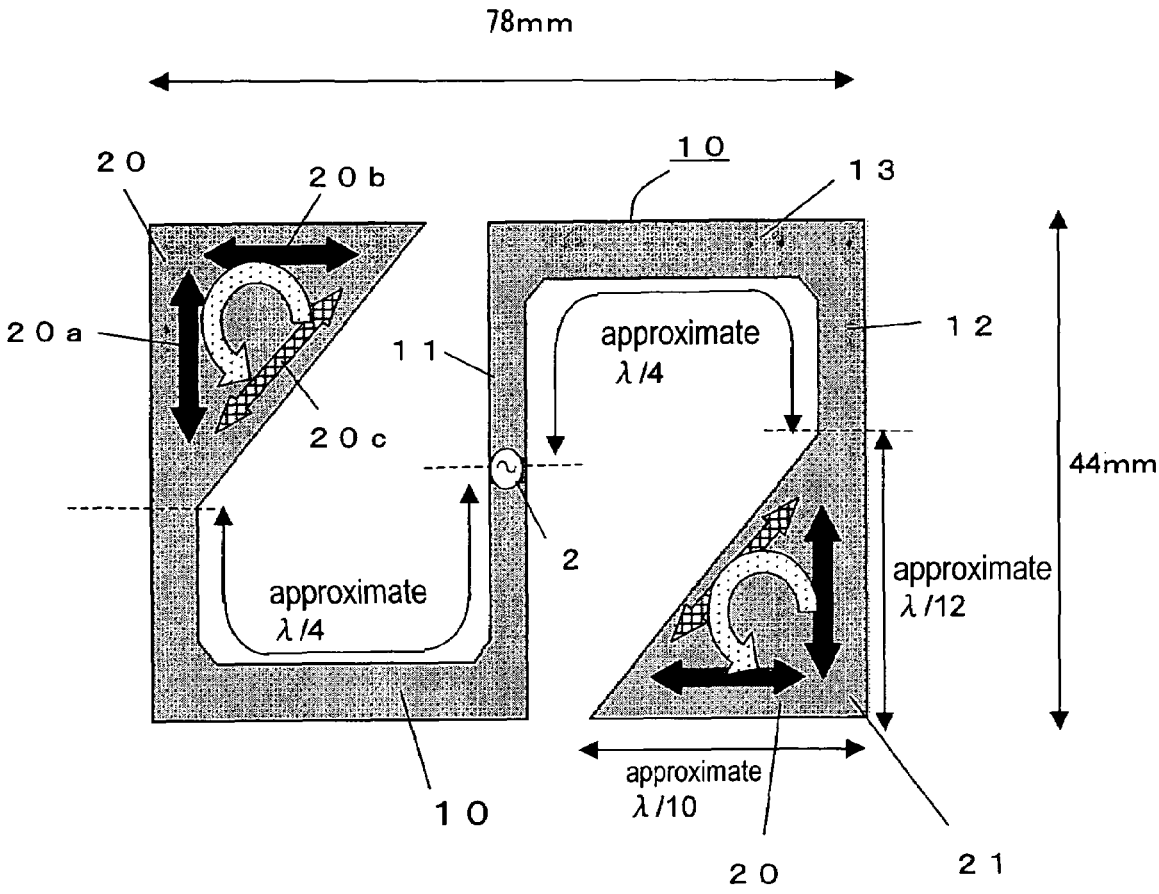
FIG. 11 is a diagram showing a specific configuration corresponding to the embodiment of FIG. 6.

Therefore, as a specific configuration corresponding to the embodiment of FIG. 6, a tag antenna was fabricated with dimensions shown in FIG. 11 (78 * 44 $mm^2$). When a signal with f=953 MHz was sent from an antenna (leftward polarization, 0.7 db axial ratio) on the reader/writer side, as compared to a communication distance of a conventional linear polarization tag, the communication distance was reduced by 25% when the front side (z direction=the upper side direction of the page) was faced to the reader/writer side and was increased by 27% when the back side (−z direction=the upper side direction of the page) was faced to the reader/writer side as a result. These numeric values approximately conform to the prediction result described above.

In the tag antenna shown in FIG. 11, since the circular polarized wave generation portion 20 leading to the λ/4-long dipole portion 10 has a 90-degree bending portion 21 at a portion extending from the end of the dipole portion 10, longitudinal-direction and transverse-direction currents 20*a*, 20*b* are combined to generate an oblique-direction current 20*c* and the direction of the current is rotated in an anticlockwise direction in the circular polarized wave generation portion 20.

On the other hand, anticlockwise rotation is generated on the side symmetric relative to the feeding point 2, and a circular polarization component of leftward polarization is added in the antenna as a whole. However, since the linearly polarized wave of the dipole portion 10 has an effect on the characteristic of the antenna as a whole, a main constituent is the linearly polarized wave and, by adding the appropriate leftward polarization component, an axial ratio of 10 dB can be obtained.

Figure 12:
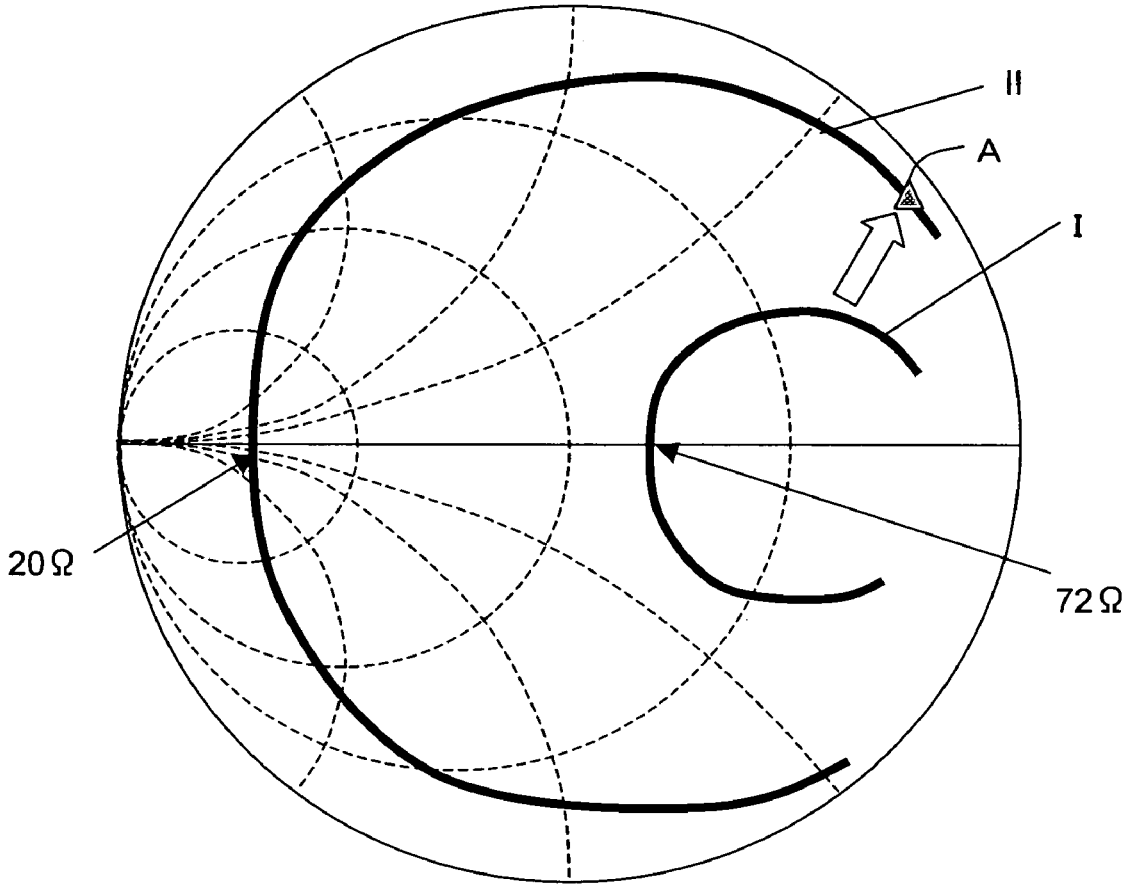
FIG. 12 is a diagram describing an impedance characteristic of the antenna with the configuration of FIG. 11.

With regard to impedance, as shown in FIG. 12, although a dipole (about λ/2 long=145 mm) typically has f=953 MHz and impedance=72 Ω (an imaginary number component=0), in general, if the dipole portion has a bending portion, the impedance with an imaginary part=0 is reduced to 20 Ω, for example. Consequently, the impedance is depicted larger such that a curve I on a smith chart is changed to a curve II.

In the present invention, since an entire length of the antenna is longer than λ/2, a point of f=953 Mhz is rotated in a clockwise direction to a point A shown in FIG. 12 and the antenna radiation resistance Ra is increased to the extent of 1000 to 2000 Ω. In this way, matching with the chip can be achieved.

Second Embodiment

Figure 13:
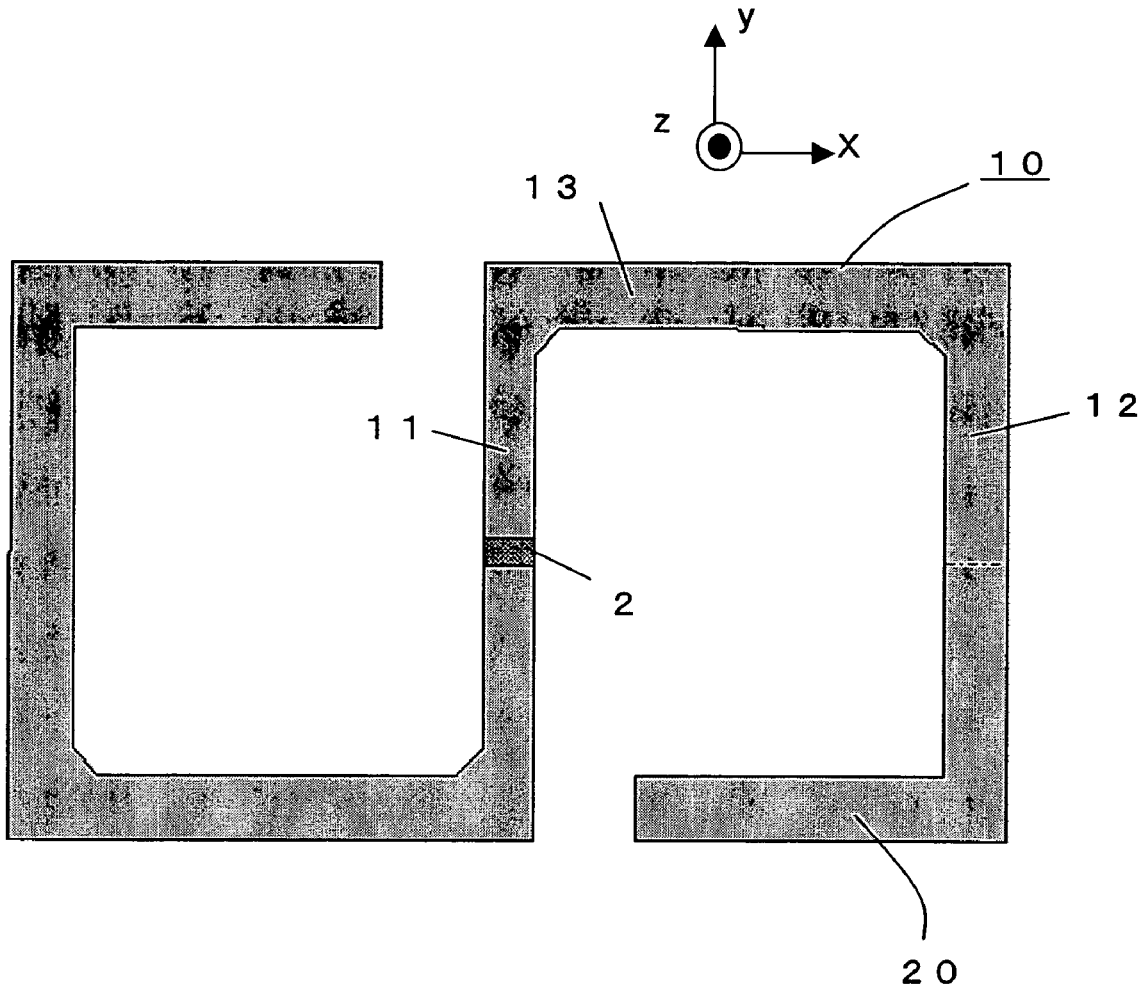
FIG. 13 is a plan view of an example of a tag antenna of a second embodiment according to the present invention.
Figure 14:
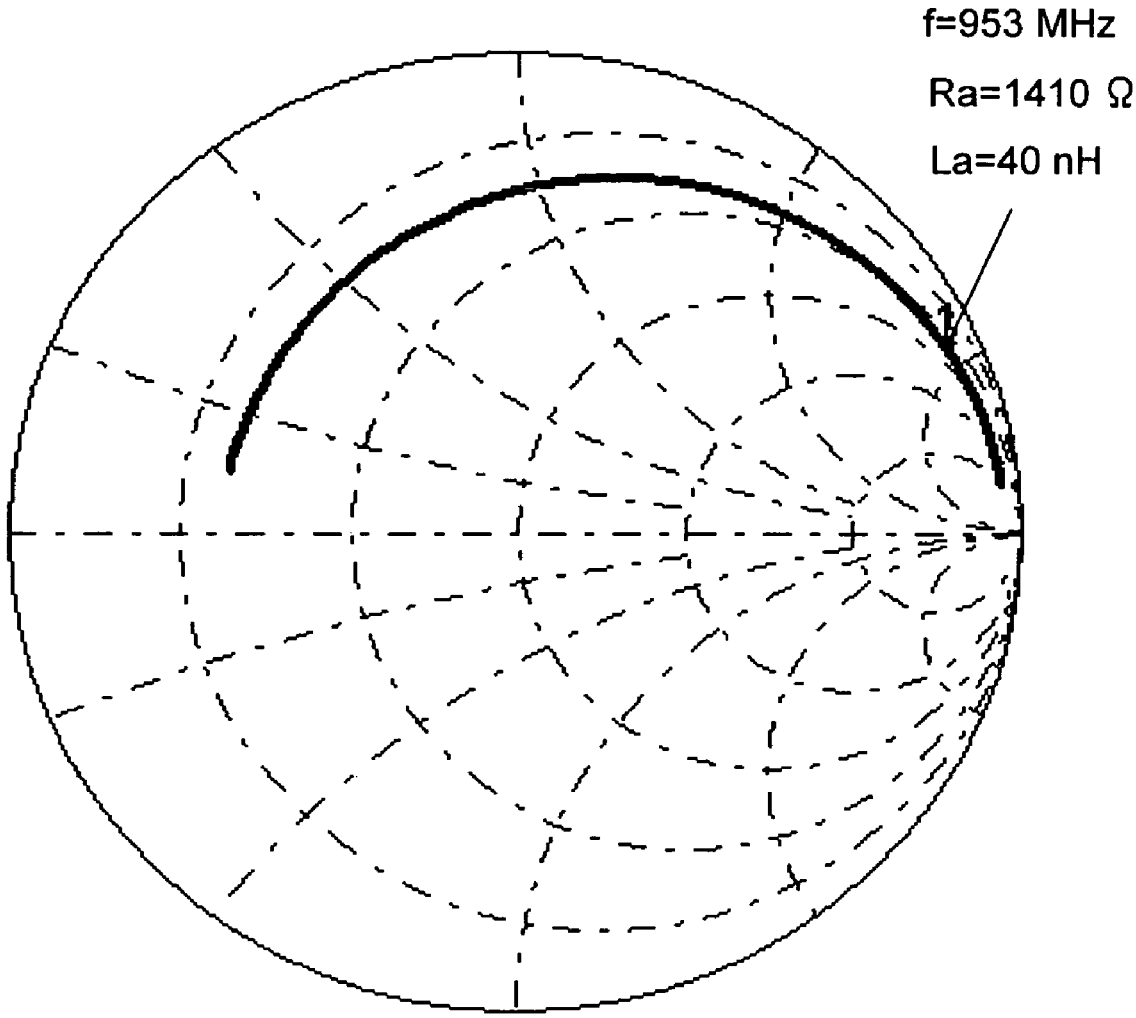
FIG. 14 is a diagram describing an impedance characteristic of the tag antenna of the second embodiment.

FIG. 13 is a plan view of an example of a tag antenna of a second embodiment according to the present invention. Unlike the triangular shape in the embodiment of FIG. 6, the circular polarized wave generation portion 20 has an L-shape. As shown in FIG. 14, impedance has f=953 MHz, Ra=1410 Ω and La=40 nH and can be matched with the chip.

Figure 15:
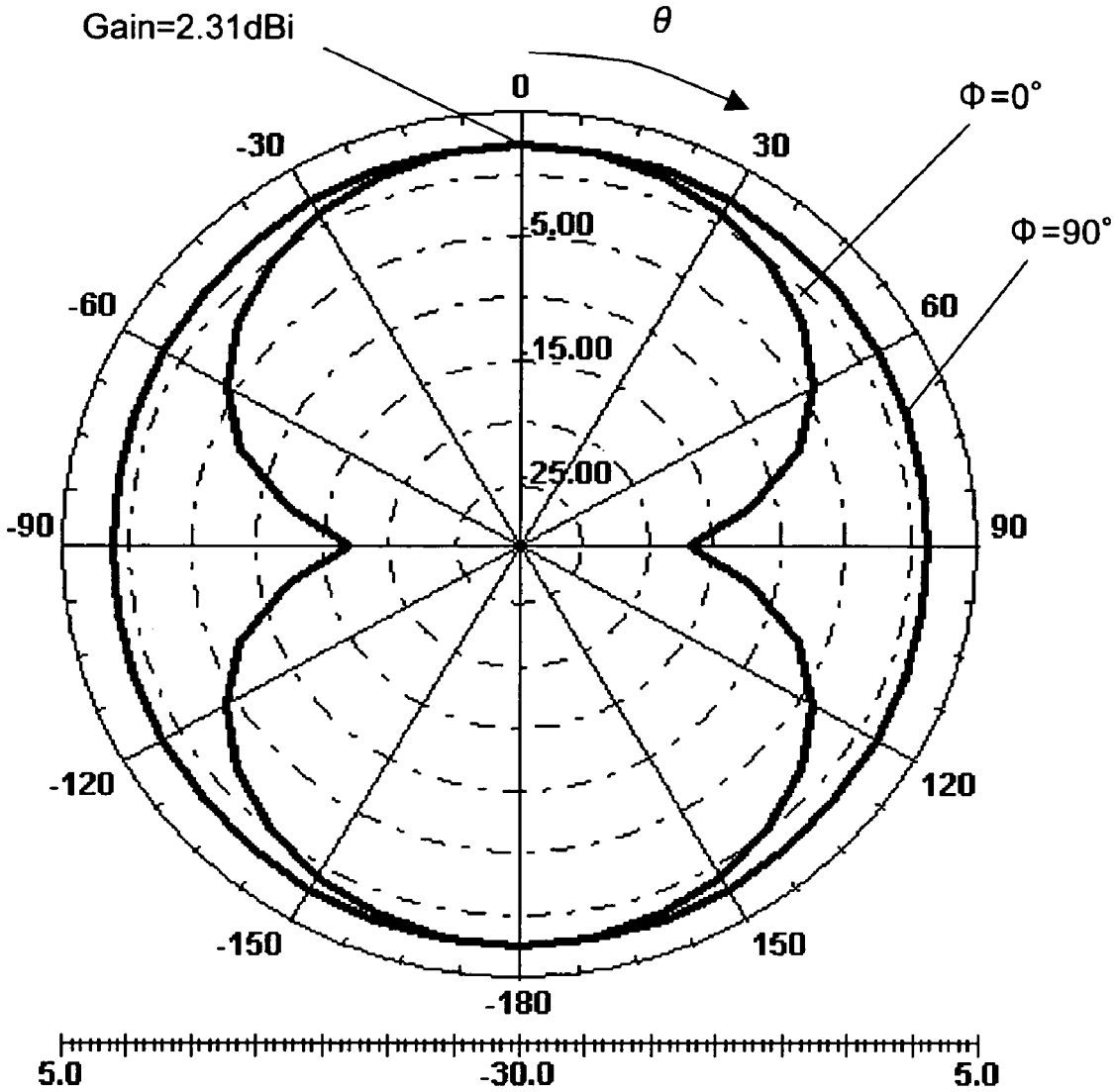
FIG. 15 is a diagram showing an antenna gain and a radiation pattern of the second embodiment.

As shown in FIG. 15, an antenna gain in the antenna front side direction (z direction) is 2.33 dBi which is approximately the same as the embodiment of FIG. 6 and has a somewhat sharp radiating pattern, and the gain is somewhat higher than a typical dipole antenna gain of 2.15 dBi.

Figure 16:
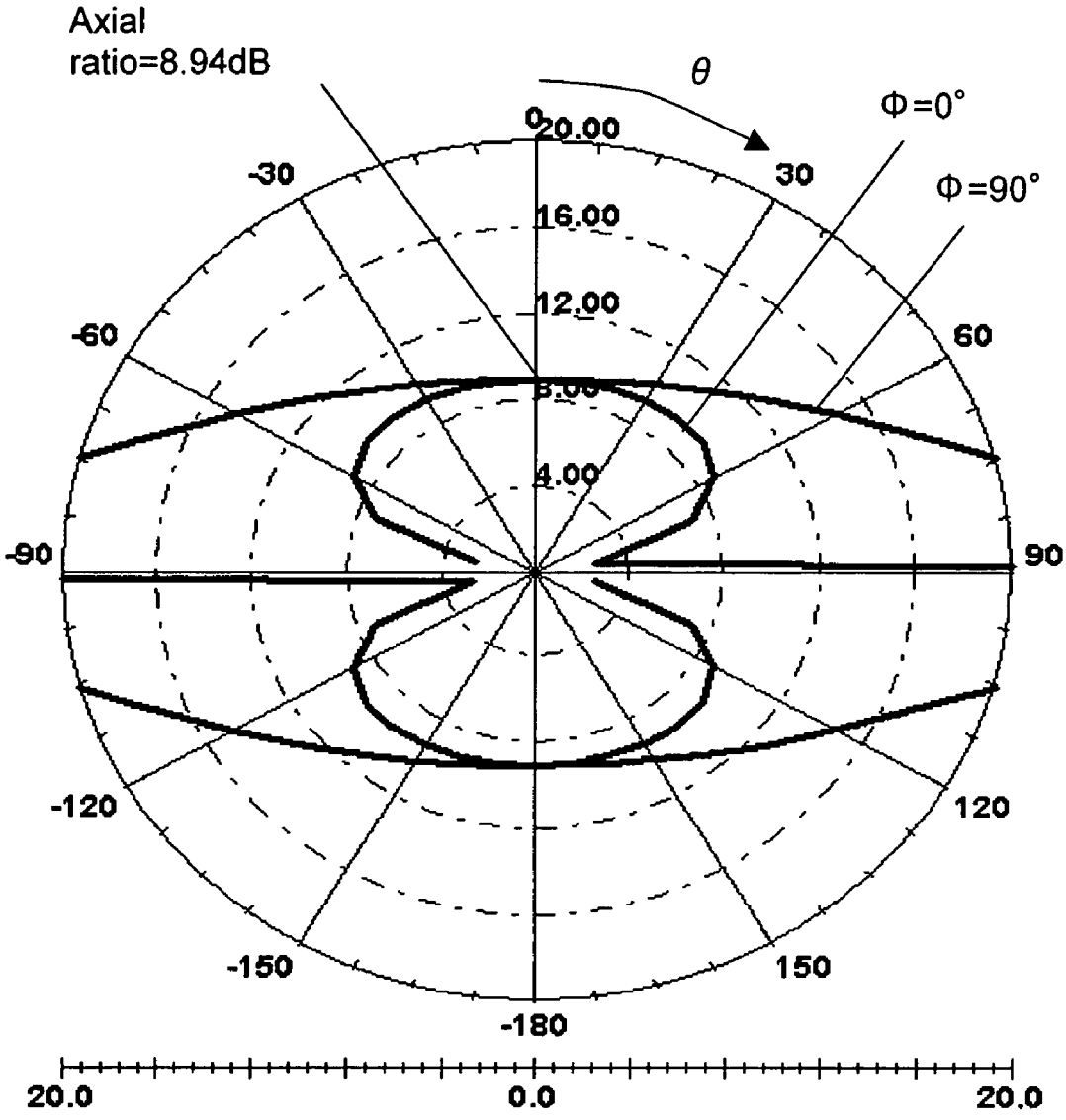
FIG. 16 is a diagram showing an axial ratio of the antenna of the second embodiment.

As shown in FIG. 16, an axial ratio of the antenna is 8.94 dB (leftward polarization). As compared to the first embodiment, circular polarization is somewhat stronger and a distance difference between the front and back sides is somewhat greater.

This is because the circular polarization component becomes greater since an oblique-direction current does not exist in the circular polarized wave generation portion 20 in the embodiment explanatory diagram of FIG. 11.

Third Embodiment

Figure 17:
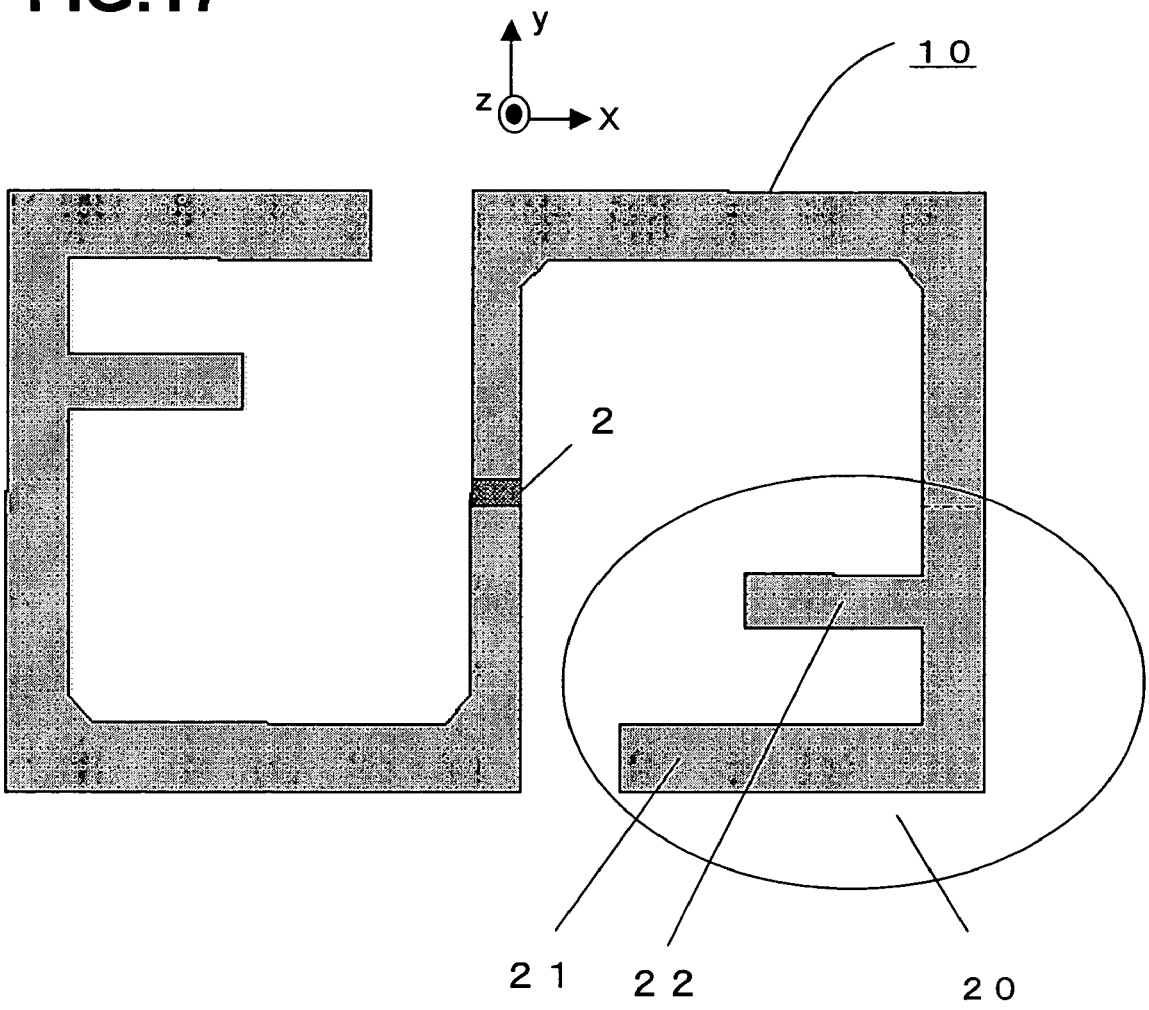
FIG. 17 is a plan view of an example of a tag antenna of a third embodiment according to the present invention.

FIG. 17 is a plan view of an example of a tag antenna of a third embodiment according to the present invention. As shown in the figure, unlike the above embodiments, the embodiment is characterized by forming the circular polarized wave generation portion 20 in an F-shape.

Figure 18:
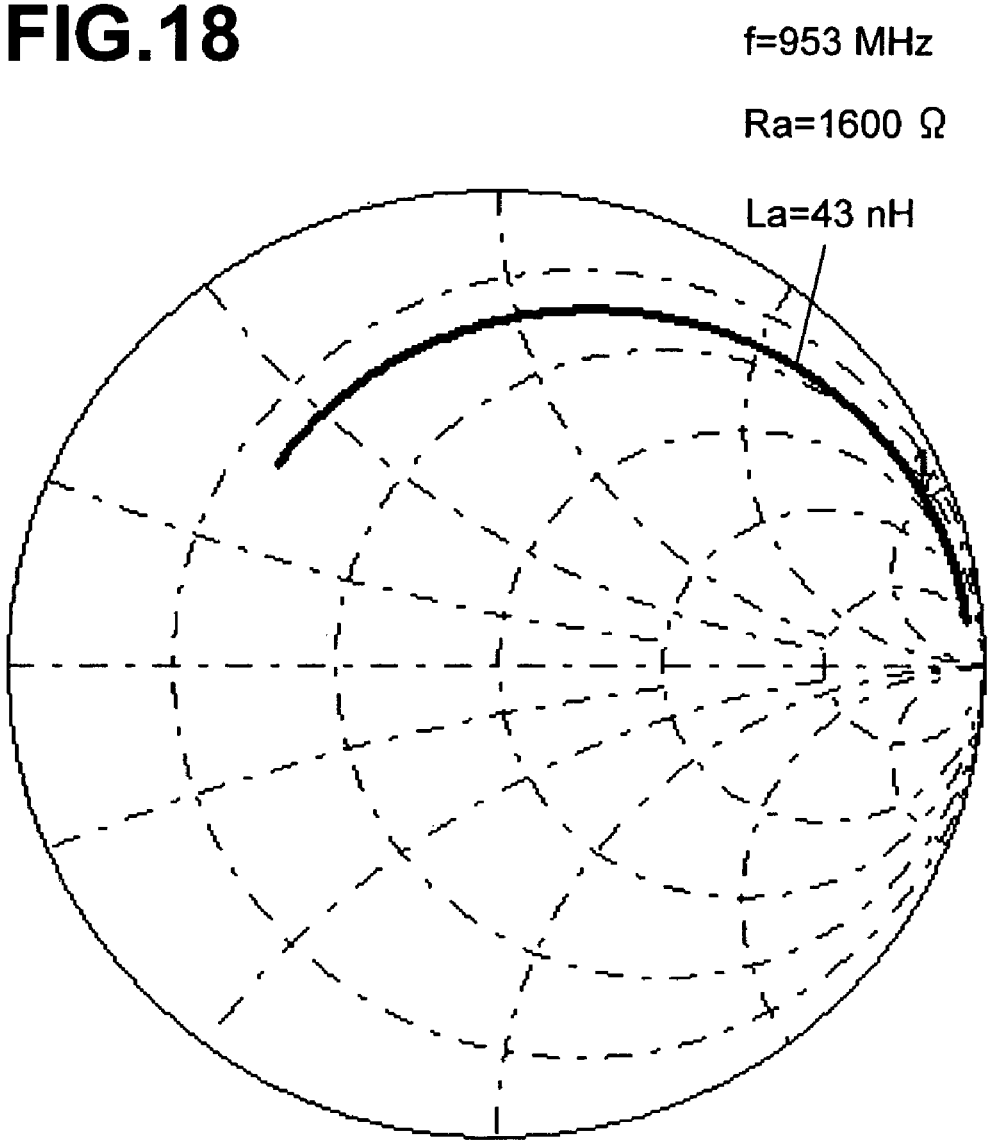
FIG. 18 is a diagram describing an impedance characteristic of the tag antenna of the third embodiment.
Figure 19:
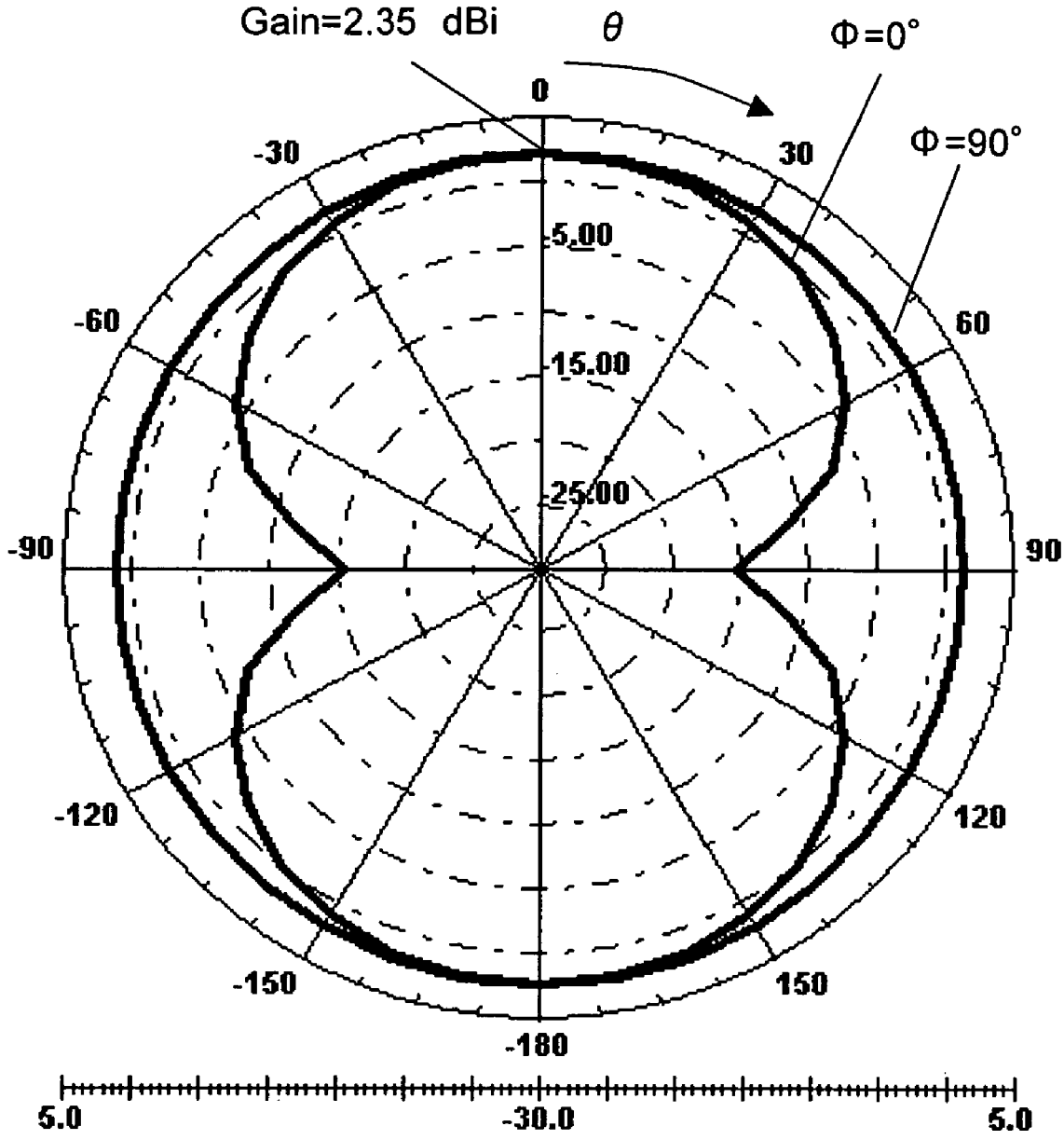
FIG. 19 is a diagram showing an antenna gain and a radiation pattern of the third embodiment.

As shown in FIG. 18, impedance in the embodiment has f=953 MHz, Ra=1600 Ω and La=43 nH and can be matched with the chip. As shown in FIG. 19, an antenna gain in the antenna front side direction (z direction) is 2.35 dBi with a somewhat sharp radiating pattern and the gain is somewhat higher than a typical dipole antenna gain of 2.15 dBi.

Figure 20:
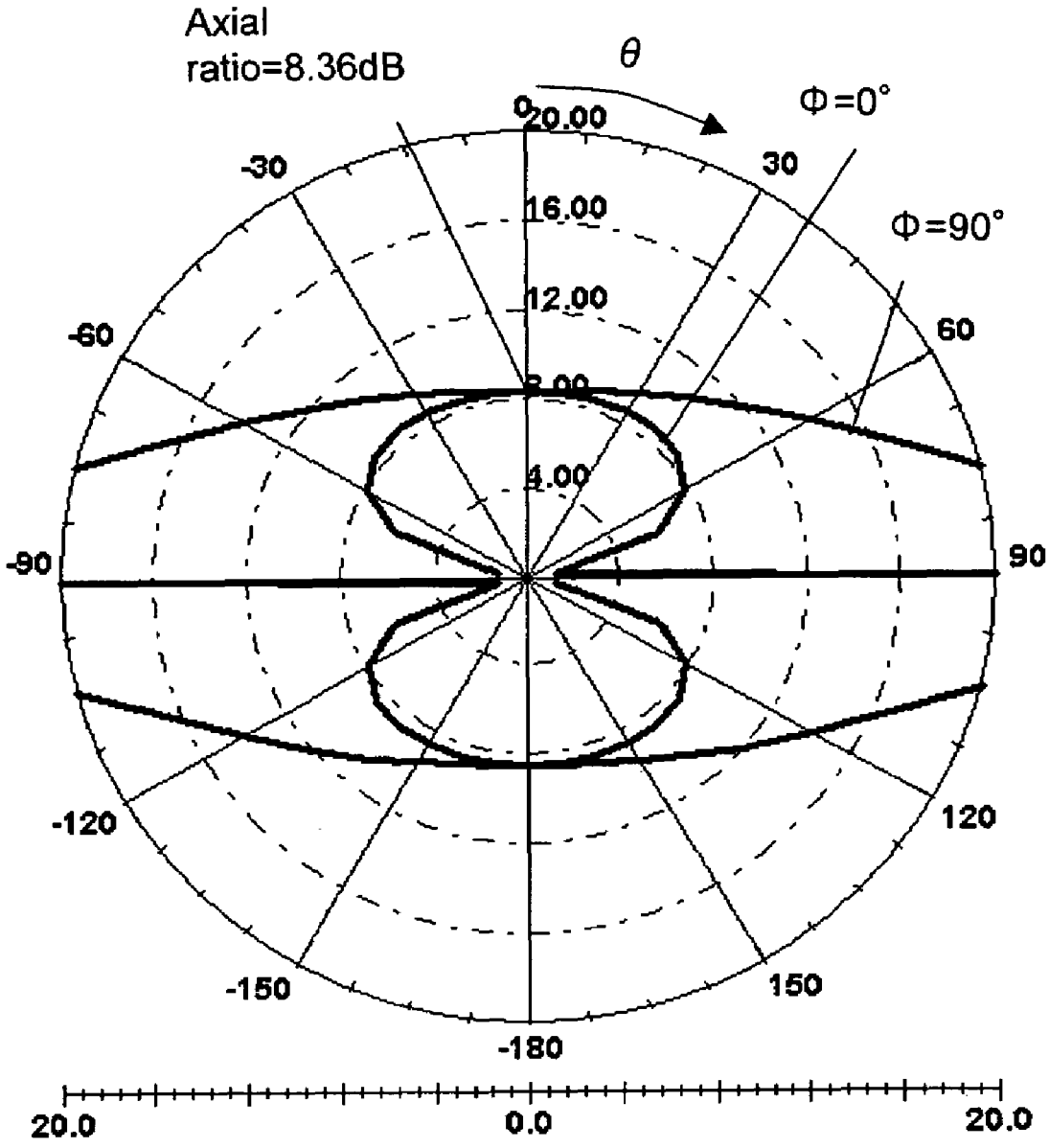
FIG. 20 is a diagram showing an axial ratio of the antenna of the third embodiment.

As shown in FIG. 20, an axial ratio of the antenna is 8.36 dB (leftward polarization). Circular polarization is stronger and a distance difference between the front and back sides is greater than the second embodiment. This is because the circular polarization component is further intensified since the circular polarized wave generation portion 20 has an F-shape and two (2) current paths 21, 22 exist in the transverse direction.

Fourth Embodiment

Figure 21:
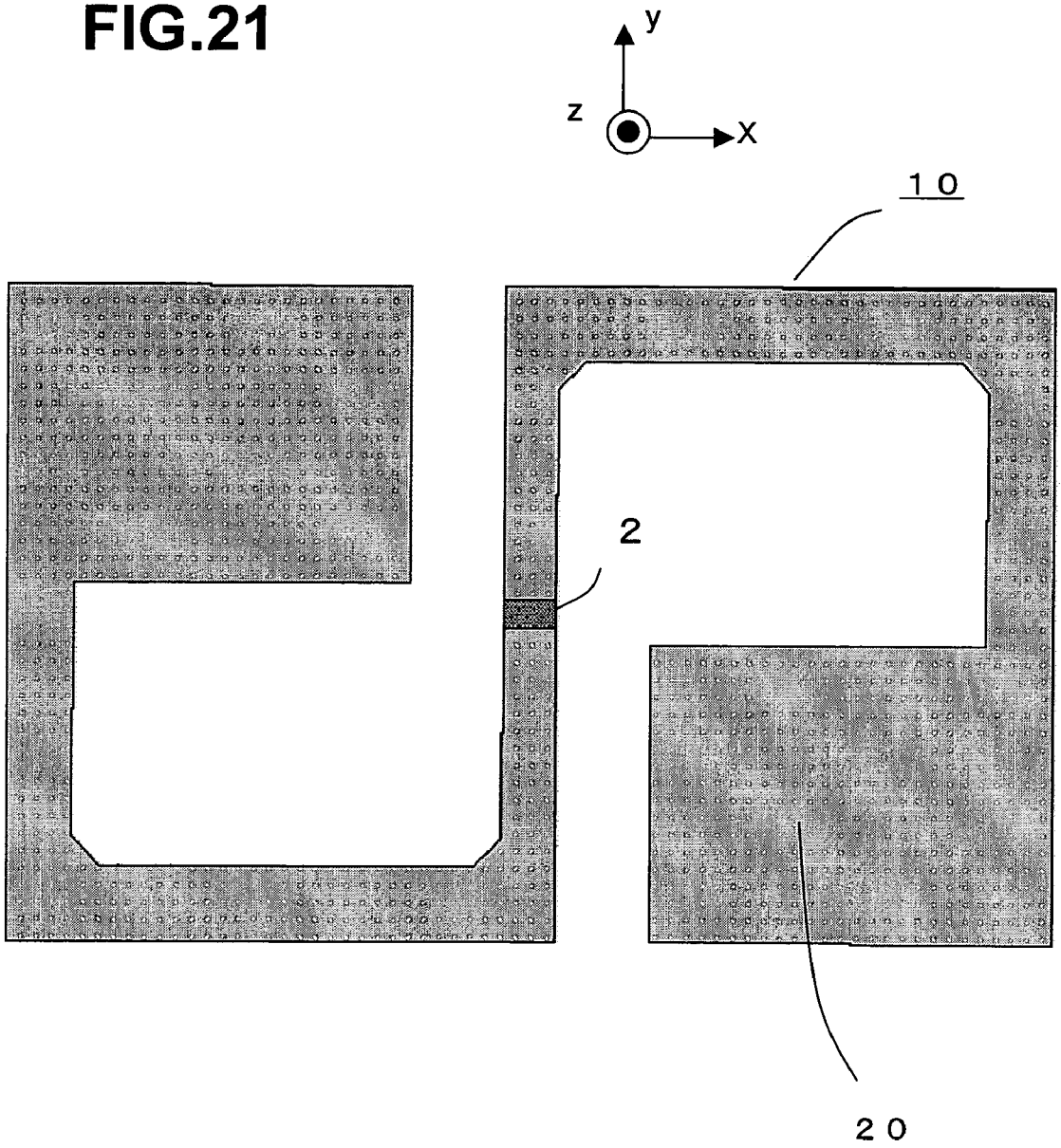
FIG. 21 is a plan view of an example of a tag antenna of a fourth embodiment according to the present invention.

FIG. 21 is a plan view of an example of a tag antenna of a fourth embodiment according to the present invention. The embodiment is characterized by forming the circular polarized wave generation portion 20 in a rectangular shape.

Figure 22:
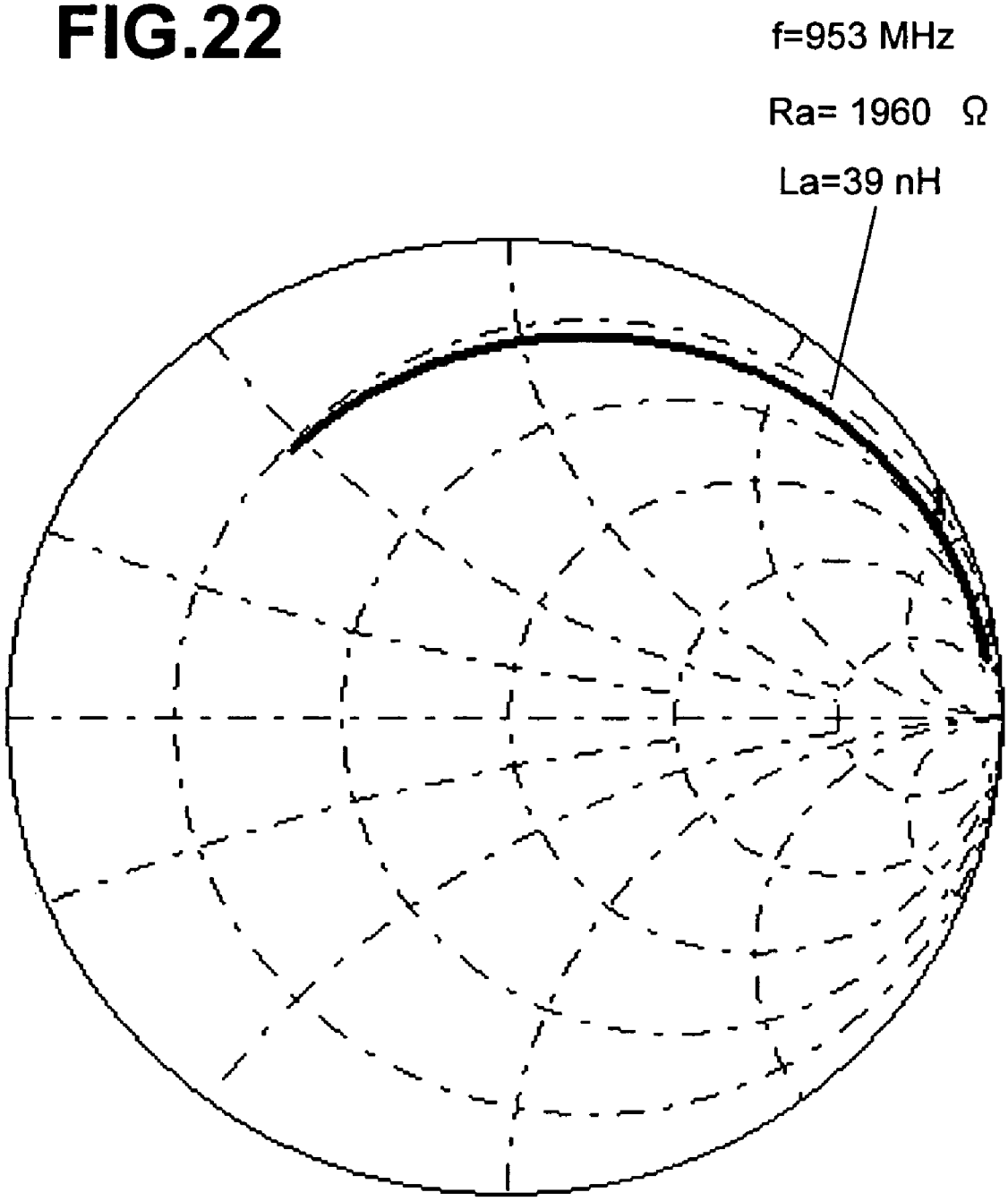
FIG. 22 is a diagram describing an impedance characteristic of the tag antenna of the fourth embodiment.
Figure 23:
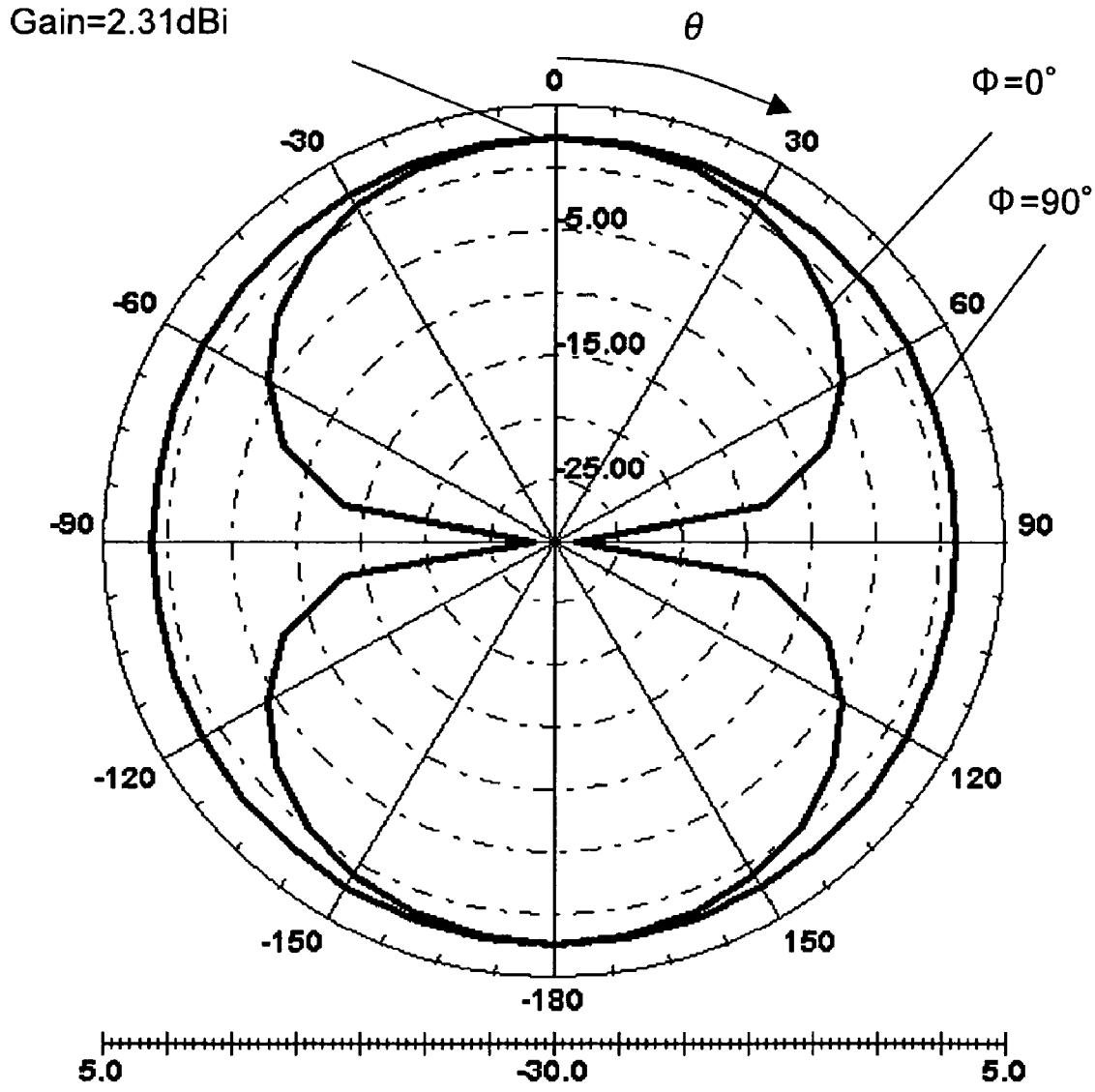
FIG. 23 is a diagram showing an antenna gain and a radiation pattern of the fourth embodiment.

As shown in FIG. 22, impedance has f=953 MHz, Ra=1960 Ω and La=39 nH and can be matched with the chip. As shown in FIG. 23, an antenna gain in the antenna front side direction (z direction) is 2.31 dBi with a somewhat sharp radiating pattern and the gain is somewhat higher than a typical dipole antenna gain of 2.15 dBi.

Figure 24:
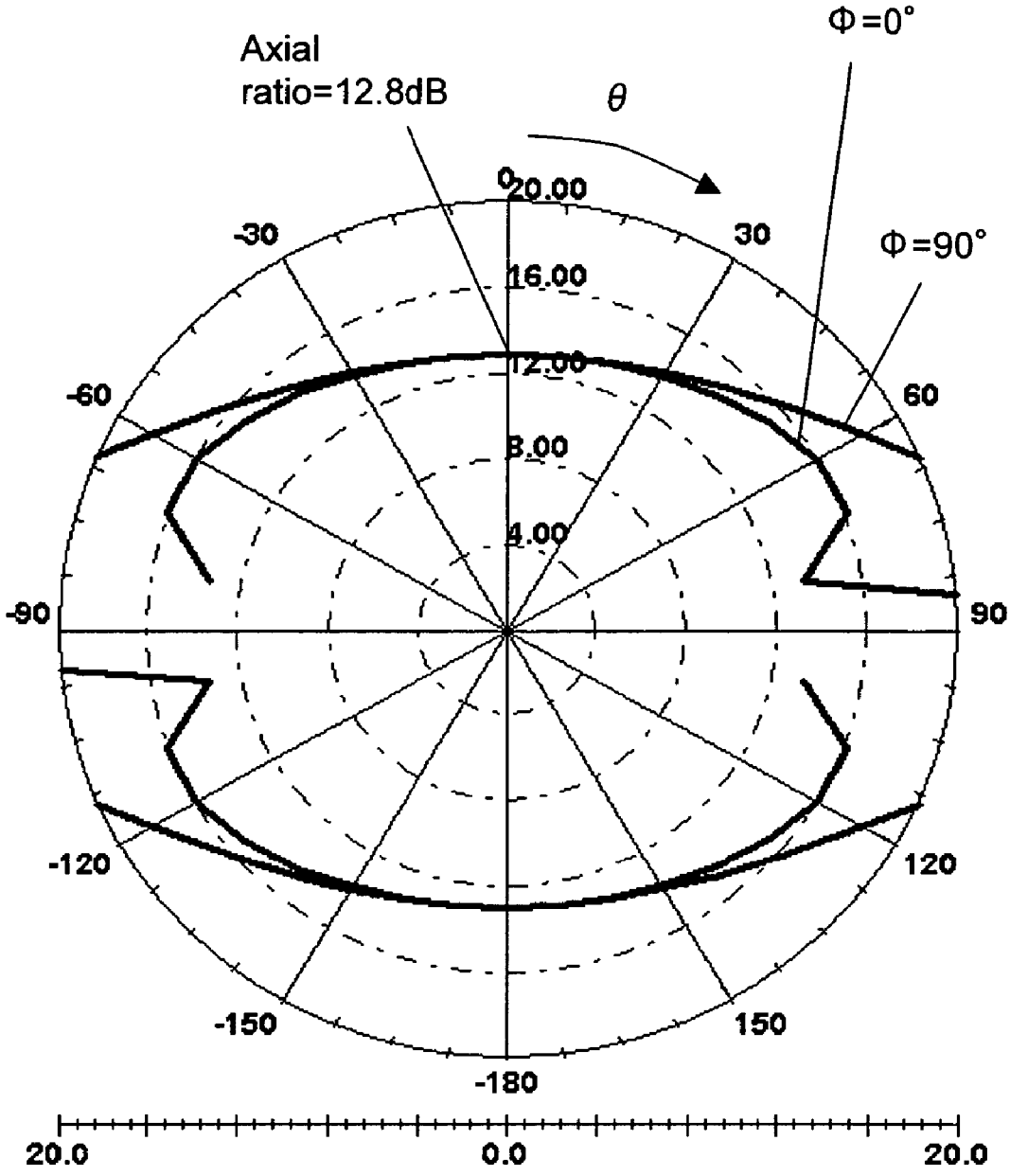
FIG. 24 is a diagram showing an axial ratio of the antenna of the fourth embodiment.

As shown in FIG. 24, an axial ratio of the antenna is 12.8 dB (leftward polarization). Circular polarization is somewhat weaker and a distance difference between the front and back sides is somewhat smaller than the first embodiment.

This is because the circular polarized wave generation portion 20 has a rectangular shape and currents are sent to various directions.

As described above, with an appropriate circular polarization component with an axial ratio of about 10 dB, a tag antenna according to the present invention can supply a tag with different communication distances on the front and back sides of the tag. Therefore, a communication distance difference due to an attached object can be canceled and an RFID system can be provided which has approximately the same communication distance regardless of an attached position (surface) of the tag.

The size of the tag is to the extent of a card size, which is practical. Since the gain is somewhat higher than a typical dipole, a communication distance can be made longer than a typical dipole.

While the illustrative and presently preferred embodiments of the present invention have been described in detail herein, it is to be understood that the inventive concepts may be otherwise variously embodied and employed and that the appended claims are intended to be construed to include such variations except insofar as limited by the prior art.

What is claimed is:

1. A tag antenna for transmitting/receiving a radio signal to/from an RFID reader/writer in an RFID system, comprising a pair of antenna elements centered on a feeding point, wherein when a carrier wavelength of the radio signal is λ, each of the pair of the antenna elements comprises:

a dipole portion which has a length from the feeding point of approximately λ/4 and a plurality of bending portions; and a circular polarized wave generation portion linked to an end of the dipole portion and, each dipole portion of the pair of the antenna elements includes two (2) parallel linear portions and a third linear potion linking the two (2) linear portions, wherein an end of one linear portion of the two (2) parallel linear portions is connected to a feeding point, wherein the circular polarized wave generation portion is connected to an end of the other linear portion of the two (2) parallel linear portions, and wherein the circular polarized wave generation portion has a triangular shape having a first side conforming with an extending direction of the other linear portion of the two (2) parallel linear portions and a second side perpendicular to the first side.

2. The tag antenna according to claim 1, wherein the second side of the circular polarized wave generation portion faces toward the feeding point so as to be parallel to the third linear portion of the dipole portion.

3. The tag antenna according to claim 1, wherein the two (2) parallel linear portions of the dipole portion has a length of λ/4 and wherein the third linear portion has a length of λ/2.

4. The tag antenna according to claim 1, wherein the first side and the second side of the circular polarized wave generation portion respectively have a length of λ/15 to λ/8.

5. A tag antenna for transmitting/receiving a radio signal to/from an RFID reader/writer in an RFID system, comprising a pair of antenna elements centered on a feeding point, wherein when a carrier wavelength of the radio signal is λ, each of the pair of the antenna elements comprises:

a dipole portion which has a length from the feeding point of approximately λ/4 and a plurality of bending portions; and a circular polarized wave generation portion linked to an end of the dipole portion and, wherein each dipole portion of the pair of the antenna elements includes two (2) parallel linear portions and a third linear potion linking the two (2) linear portions, wherein an end of one linear portion of the two (2) parallel linear portions is connected to a feeding point, wherein the circular polarized wave generation portion is connected to an end of the other linear portion of the two (2) parallel linear portions, and wherein the circular polarized wave generation portion is formed in an L-shape with a first linear portion conforming with an extending direction of the other linear portion of the two (2) parallel linear portions and a second linear portion perpendicular to the first linear portion.

6. The tag antenna according to claim 5, wherein the second linear portion of the circular polarized wave generation portion faces to the feeding point side to be parallel to the third linear portion of the dipole portion.

7. The tag antenna for transmitting/receiving a radio signal to/from an RFID reader/writer in an RFID system, comprising a pair of antenna elements centered on a feeding point, wherein when a carrier wavelength of the radio signal is λ, each of the pair of the antenna elements comprises:

a dipole portion which has a length from the feeding point of approximately λ/4 and a plurality of bending portions; and a circular polarized wave generation portion linked to an end of the dipole portion and, wherein each dipole portion of the pair of the antenna elements includes two (2) parallel linear portions and a third linear potion linking the two (2) linear portions, wherein an end of one linear portion of the two (2) parallel linear portions is connected to a feeding point, wherein the circular polarized wave generation portion is connected to an end of the other linear portion of the two (2) parallel linear portions, and wherein the circular polarized wave generation portion is formed in an F-shape with a first linear portion conforming with an extending direction of the other linear portion of the two (2) parallel linear portions and a second linear portion and a third linear portion perpendicular to the first linear portion.

8. The tag antenna according to claim 7, wherein the second linear portion and the third linear portion of the circular polarized wave generation portion face toward the feeding point to be parallel to the third linear portion of the dipole portion.

9. The tag antenna for transmitting/receiving a radio signal to/from an RFID reader/writer in an RFID system, comprising a pair of antenna elements centered on a feeding point, wherein when a carrier wavelength of the radio signal is λ, each of the pair of the antenna elements comprises:

a dipole portion which has a length from the feeding point of approximately λ/4 and a plurality of bending portions; and a circular polarized wave generation portion linked to an end of the dipole portion and, wherein each dipole portion of the pair of the antenna elements includes two (2) parallel linear portions and a third linear potion linking the two (2) linear portions, wherein an end of one linear portion of the two (2) parallel linear portions is connected to a feeding point, wherein the circular polarized wave generation portion is connected to an end of the other linear portion of the two (2) parallel linear portions, and wherein the circular polarized wave generation portion has a rectangular shape having a side conforming with an extending direction of the other linear portion of the two (2) parallel linear portions.

* * * * *